United States Patent [19]

Burkhart et al.

[11] 4,072,381

[45] Feb. 7, 1978

[54] TRACTOR-TRAILER ELECTRICAL CONNECTOR SYSTEM

[75] Inventors: James G. Burkhart, Dallas; Montgomery P. Burkhart, Rockwall; James D. Coley, Rickwall, all of Tex.

[73] Assignee: Air-Tex Wire Harness, Inc., Garland, Tex.

[21] Appl. No.: 737,678

[22] Filed: Nov. 1, 1976

Related U.S. Application Data

[63] Continuation-in-part of Ser. No. 568,922, April 17, 1975, abandoned.

[51] Int. Cl.[2] ..... H01R 13/44; H01R 13/52

[52] U.S. Cl. ..... 339/29 R; 339/39; 339/44 M; 339/102 R; 339/218 M

[58] Field of Search ..... 339/28, 29 R, 36, 39, 339/44, 63 R, 63 M, 102 R, 218 R, 218 C, 218 M, 278 C

[56] References Cited

U.S. PATENT DOCUMENTS

| | | | |
|---|---|---|---|
| 762,684 | 6/1904 | Case | 339/44 R |
| 894,644 | 7/1908 | Hill | 339/102 R |
| 1,936,469 | 11/1933 | Hill | 339/278 C |
| 3,284,753 | 11/1966 | Goldbaum | 339/44 R |
| 3,594,696 | 7/1971 | Witek | 339/218 R |

FOREIGN PATENT DOCUMENTS

| | | | |
|---|---|---|---|
| 1,138,161 | 1/1957 | France | 339/218 R |

*Primary Examiner*—Roy Lake
*Assistant Examiner*—Mark S. Bicks
*Attorney, Agent, or Firm*—Richards, Harris & Medlock

[57] ABSTRACT

The specification discloses a tractor-trailer electrical connector system including a first socket for being mounted in the tractor cab and having a plurality of male terminals for being wired to the fuse box of the tractor. A second socket is provided for being mounted in the trailer and includes a plurality of male terminals for being wired to the trailer terminal box. A multiwire cable is provided with a length to extend between the first and second sockets. First and second plugs are integrally molded to the ends of the cable, with each plug having a plurality of female receptacles dimensioned to receive the male terminals of the first and second sockets. Each of the sockets and plugs includes an inner core of elastomeric material which surrounds and insulates the terminals or receptacles. A rigid synthetic polymer housing covers the inner core to provide one piece sockets and plugs.

3 Claims, 14 Drawing Figures

TRACTOR-TRAILER ELECTRICAL CONNECTOR SYSTEM

RELATED APPLICATIONS

This application is a continuation-in-part of application Ser. No. 568,922, filed Apr. 17, 1975, entitled "Trailer-Tractor Electrical Connector System"and now abandoned.

FIELD OF THE INVENTION

This invention relates to electrical connector systems, and more particularly relates to an electrical connection system for applying electrical power from a towing vehicle to a trailer.

THE PRIOR ART

In an over-the-road tractor-trailer, it is necessary to supply power from the electrical system of the tractor to the trailer in order to operate the trailer lights, anti-skid devices and the like. Heretofore, cables and connector systems have been provided which include metal plug and socket housings in order to interconnect an electrical cable between the tractor and the trailer. Such previously developed systems have not been completely satisfactory, due to deterioration of the metal housings from rust and corrosion. Moreover, such metal housings generally have been constructed from a plurality of pieces which must be individually fabricated and screwed together during assembly, thereby increasing costs of manufacture and insulation. A need has thus arisen for a tractor-trailer electrical connector system which is relatively inexpensive to manufacture and simple to install, and yet which provides excellent electrical characteristics and is not subject to deterioration due to exposure to the weather and the elements.

SUMMARY OF THE INVENTION

In accordance with the present invention, a tractor-trailer electrical connector system is provided which substantially eliminates or reduces the problems heretofore associated with prior tractor-trailer electrical connections.

In accordance with the present invention, a tractor-trailer electrical connector system includes a first socket for being mounted in a trailer cab and having a plurality of male terminals for being wired to the electrical system of the tractor. A second socket is adapted to be mounted in a trailer and includes a plurality of male terminals for being wired to the trailer terminal box. A multiwire cable has a length to extend between the first and second sockets. First and second plugs are integrally molded to the ends of the cable and each plug includes a plurality of female receptacles dimensioned to receive the male terminals of the first and second sockets. Each of the plugs includes an outer housing of rigid synthetic polymer molded over one end of the cable.

DESCRIPTION OF THE DRAWINGS

For a more detailed description of the present invention and for further objects and advantages thereof, reference is now made to the following description taken in conjunction with the accompanying drawings, in which.

DESCRIPTION OF THE PREFERRED EMBODIMENT

Figure 1:
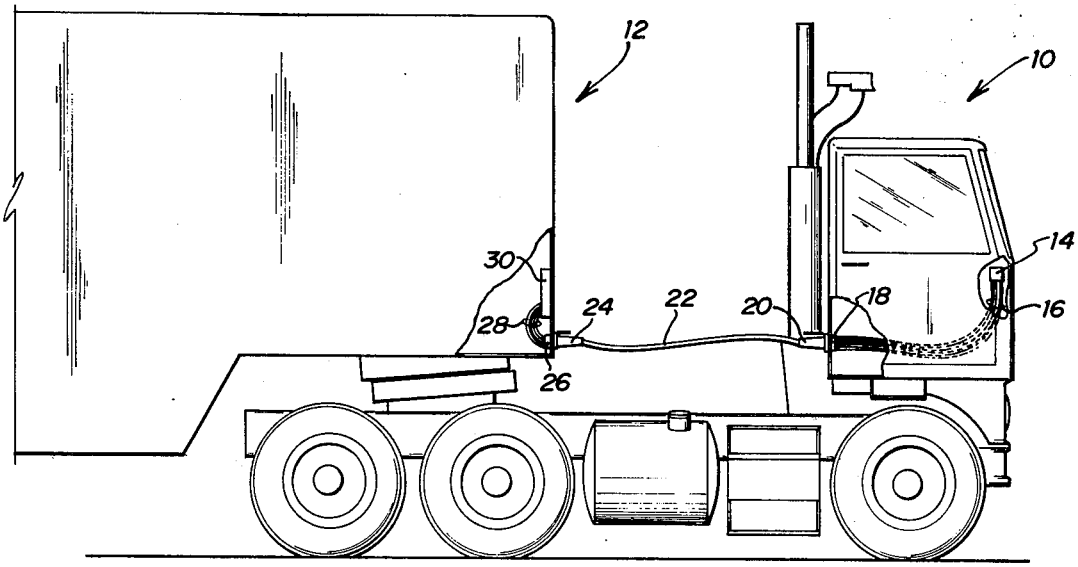
FIG. 1 is a somewhat diagrammatic illustration of the installation of the present electrical connector system in an over-the-road tractor-trailer.

Referring to FIG. 1, an over-the-road tractor is generally designated by the numeral 10 and is connected in the conventional manner for towing a large trailer generally designated by the numeral 12. It is necessary to supply power from the electrical system of the tractor 10 to the trailer 12 in order to operate lights on the trailer, anti-skid devices, and the like. A fuse box 14 is normally located on the tractor 10 and in accordance with the present invention a plurality of wires 16 are directed from the fuse box 14 to a socket 18 connected through the rear wall of the tractor 10.

Male terminals in the socket 18 interconnect with female terminals in a plug 20 which is interfitted with the socket. A rubber cable 22 contains a plurality of electrical wires which extend from the female terminals in plug 20 to similar female terminals in a plug 24. Plugs 20 and 24 are integrally molded over the ends of cable 22 to form a unitary watertight plug and cable unit. The electrical terminals in plug 24 receive male terminals in a second socket 26 which is mounted on the front wall of the trailer 12 and extends through an aperture therein. Wires 28 extend from the male terminals in the socket 26 to a terminal box 30 which is mounted in the trailer 12. Electrical connections are made from the terminal box 30 to the lights, anti-skid devices and other electrical devices requiring power in the trailer 12 in a conventional manner.

As will be subsequently described, the sockets and plugs of the present invention are integrally molded from plastic material and are not therefore subject to deterioration by corrosion or the like. Due to the fact that the sockets and plugs are exposed to the elements during operation of the tractor-trailer, the present connector system provides far greater wear and less required maintenance than previously developed metal connector systems. Moreover, the present system is fabricated as a complete assembled unit, and thus needs only to have the sockets attached in the desired places and the plugs hooked into the sockets in order to provide a working system.

Figure 2:
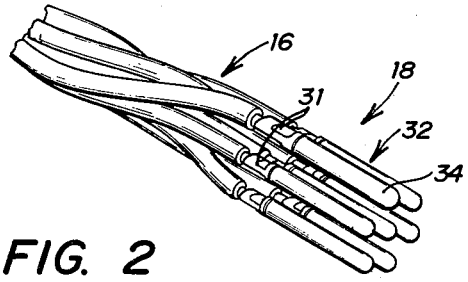
FIG. 2 is a perspective view illustrating the initial steps in construction of the socket of the invention.

FIG. 2 illustrates the first step in assembling of the socket 18. It will be understood that sockets 18 and 26 are identical in construction. Similarly, plugs 20 and 24 are identical in construction.

A plurality of electrical wiring 16 extends from the fuse box 14. The ends of the wires 16 are bared and are crimped or soldered to the rear ends 31 of a plurality of male terminals or pins 32. In the preferred embodiment, seven male terminals are provided, with one of the terminals 34 being of an enlarged size and length.

Figure 3:
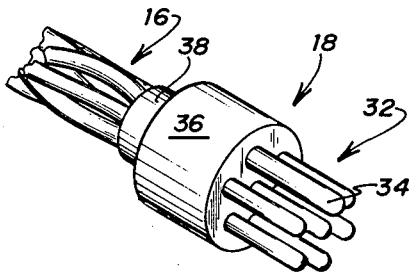
FIG. 3 is a perspective view of a subsequent step in the fabrication of the present socket.

FIG. 3 illustrates a subsequent step in the assembly of the socket 18. The pins 32 are disposed in an injection molding machine and an elastomeric core 36 is formed over the rear ends 31 of the terminals 32 and covering and insulating the connections between the wires 16 and the terminals 32. As shown in FIG. 3, the core 36 includes a large cylindrical portion and a smaller diameter rear circular portion 38. Core 36 may be formed from any suitable elastomeric material, and PVC Vinyl has been found to work well in practice. The core 36 not only protects the electrical connections between the terminals 32 and the wires 16, but orients the terminals 32 in the desired position. Core 36 thus provides a unitary watertight support housing for the terminals 32.

Figure 4:
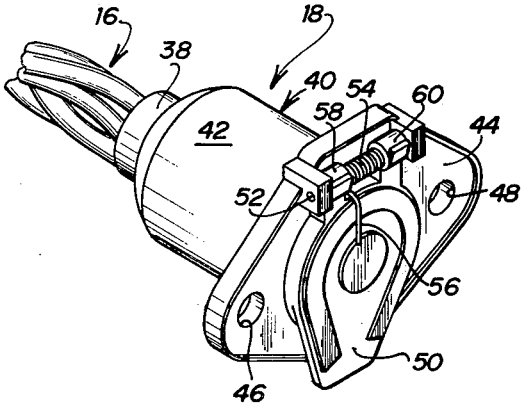
FIG. 4 is a perspective view of the finished socket of the present invention, with the socket cover in the closed position.

FIG. 4 illustrates the final embodiment of the socket 18. The core 36 and terminals 32 are placed again in an injection molding machine with different molds involved, and a rigid synthetic polymer is injection molded as a unitary housing 40 about the core 36 and the terminals 32. Only rear portion 38 of the core 36 is exposed after the formation of housing 40. Housing 40 includes a generally cylindrical rear portion 42 and a front flange 44. Flange 44 includes apertures 46 and 48 to enable connection to a cab well. Housing 40 includes a cover 50 pivotally connected to the flange 44 by a shaft 52. A spring 54 is wound about the shaft 52 and includes an end portion 56 which abuts against the cover 50. Cover 50 includes extending arms 58 and 60 which encircle the shaft 52 and which includes abutment portions for properly positioning the cover 50 when in the open position.

Figure 5:
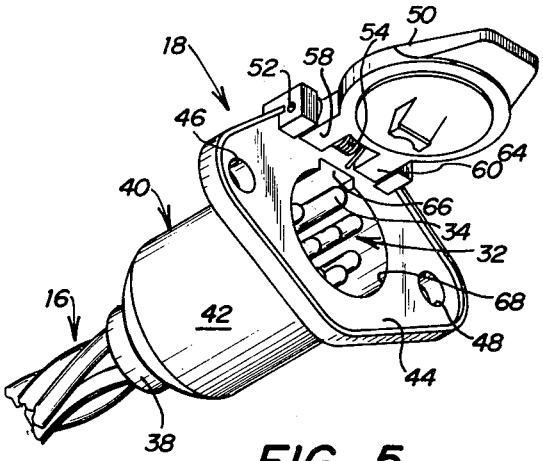
FIG. 5 is a perspective view of the socket shown in FIG. 4 with the socket cover in the open position.

FIG. 5 illustrates the housing 40 with the cover 50 in the open position, thereby exposing the ends of the male terminals 32. The enlarged terminal 34 is positioned near the top of the socket 18 in order to properly orient the mating plug in the manner to be subsequently described. The bottom of the cover 50 includes a locking member 64 for locking with the plug as will be subsequently described. When the cover 50 is placed in the open position, the spring 54 is wound, therefore exerting tension on the cover 50 in order to cause it to automatically close when the plug is removed. A slot 66 is formed in the top of the circular opening in the housing 40 in order to receive a similarly shaped plug member.

The socket housing 40 may be formed from any suitable generally rigid synthetic polymer such as high density nylon, polyethylene, polycarbonate, or the like. The rigid housing 40 provides protection to the terminals 32 and the housing is not subject to deterioration due to corrosion or exposure to the elements. The housing 40 further protects the inner core 36, therefore providing a watertight long lasting socket device.

Figure 6:
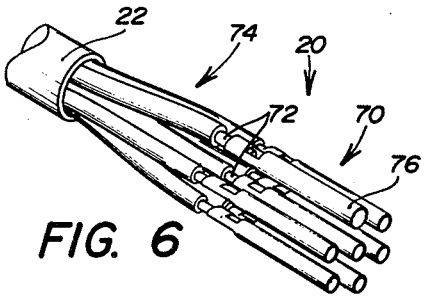
FIG. 6 is a perspective view of the initial steps of fabrication of the plug of the present invention.

FIG. 6 illustrates the initial steps in constructing plug 20. It will be understood that plug 24 is identical to plug 20 and will be constructed in the same manner. A plurality of female terminals or receptacles 70 are attached at 72 to a plurality of electrical cable wires 74 which extend from the end of the cable 22. In the preferred embodiment, seven cable wires 74 are provided. A female terminal 76 is provided with larger dimensions than the remainder of the terminals 70 in order to accommodate the large male terminal 34. The terminals 76 are connected at 72 to wire 74 by crimping or by welding.

Figure 7:
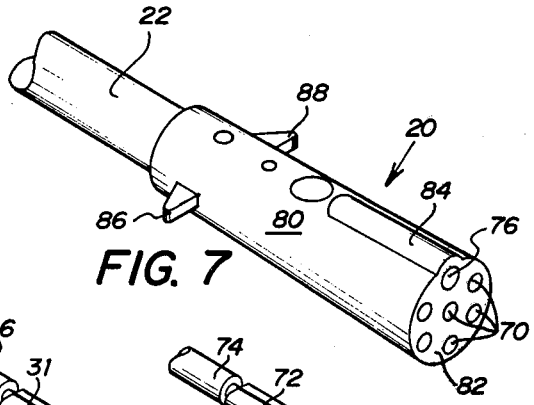
FIG. 7 is a perspective view of a subsequent step in the fabrication of the present plug.

FIG. 7 illustrates a subsequent step in the formation of the plug 20. The terminals 70 are placed in an injection molding machine and an elastomeric plug core 80 is formed thereover. As shown in FIG. 7, the elastomeric plug 80 includes a generally cylindrical body which tapers slightly outwardly to a front face 82 which has apertures therein to expose the ends of the female terminals 70 and 76. An elongated projection 84 is formed on the upper end of the core. Outwardly projecting wings 86 and 88 extend from the rear end of the core 80. The core 80 may be formed from any suitable elastomeric material such as PVC Vinyl or the like.

Figure 8:
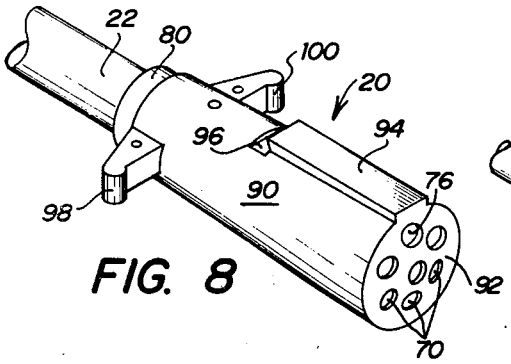
FIG. 8 is a perspective view of a first embodiment finished plug in accordance with the invention.

FIG. 8 illustrates the final step in the formation of plug 20 in accordance with one embodiment of the invention. The core 80 shown in FIG. 7 is placed in an injection molding machine having suitable molds therein and a synthetic polymer is molded thereover to expose a portion of core 80 to form a rigid outer plug housing 90. Housing 90 may be formed from any suitable rigid synthetic polymer such as high density nylon, polyethylene, polycarbonate or the like. The housing 90 includes a front face 92 with apertures formed therein in order to expose the open ends of the female terminals 70. Enlarged female terminal 76 is positioned at the top of the plug 90 in order to accommodate the enlarged male terminal 34.

An elongated projection 94 is formed along the top of the housing 90 in order to fit within the groove 66 (FIG. 5) of the housing 40. A groove 96 is formed to receive the end of the locking member 64 (FIG. 5). Wing members 98 and 100 extend outwardly from the housing 90 in order to enable grasping by the operator for easy removal of the plug from the socket. The rear end of the plug core 80 extends from the rear of the housing 90 in order to insure a watertight device. The housing 90 is provided with a generally cylindrical configuration which tapers slightly from the rear to the forward face 92. An important aspect of the present plug is that it is permanently molded to the end of cable 22 in a watertight and weathertight configuration.

Figure 9:
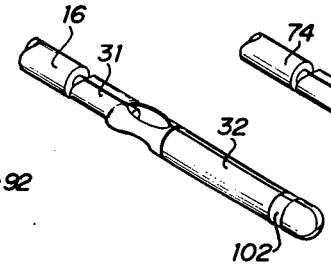
FIG. 9 is a perspective view of the male terminal of the invention.

FIG. 9 illustrates a perspective view of a male terminal 32 particularly adapted for use with the present invention. Terminal 32 may be attached to a wire 16 by crimping at end 31. Terminal 32 is comprised of any suitable conductive metal. An important aspect of the present invention is the provision of a strip 102 of a second highly conductive metal, such as gold, which is noncorrosive.

Figure 10:
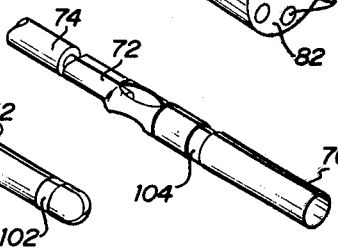
FIG. 10 is a perspective view of a female terminal in accordance with the invention.

FIG. 10 illustrates the preferred embodiment of the female terminal 70 of the invention which is sized to receive the male terminal 32. Terminal 70 is attached to a wire 74 by crimping at 72 in the manner previously described. Terminal 70 is formed of any suitable conductive metal such as is normally used. An important aspect of the invention is the provision of a strip 104 of a second type of highly conductive metal, such as gold, which is not corrosive. When the male terminal shown in FIG. 9 is inserted within the female terminal shown in FIG. 10, the strips 102 and 104 are in contact with one another. Thus, the present terminals do not tend to lose electrical conduction characteristics due to corrosion or the like, as the gold strips 102 and 104 continuously maintain electrical contact therebetween.

Figure 11:
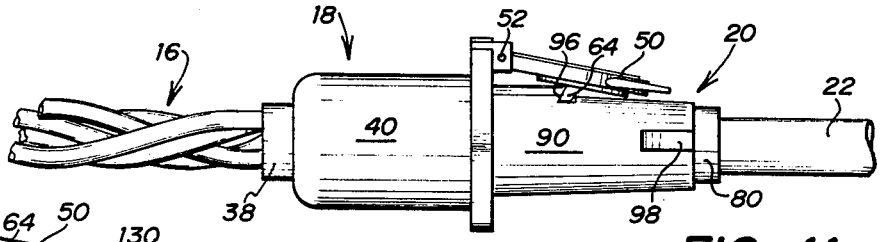
FIG. 11 is a side view illustrating the interconnection between the socket and the first embodiment of the plug shown in FIG. 8 of the invention.

FIG. 11 illustrates the connection between socket 18 and plug 20. The cover 50 of the socket 18 is opened, with the locking member 64 received within the groove 96 of the plug. When it is desired to remove the plug 20, the cover 50 is lifted slightly, the plug is grasped by the wing members 98-100 and removed from the socket, and the cover 50 is flipped down to the closed position by operation of the spring 54.

Figure 12:
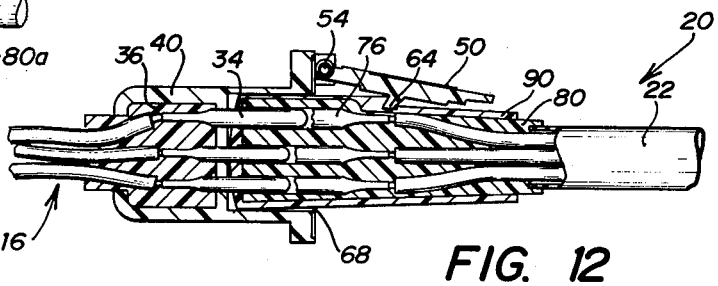
FIG. 12 is a partially sectioned view of the socket and first embodiment of the plug shown in FIG. 11.

FIG. 12 illustrates a partially sectioned view of the interconnected socket and plug as shown in FIG. 11. This figure illustrates how the plug housing 90 fits within the cylindrical opening 68 of the socket housing 40. The enlarged male terminal 34 is received within the enlarged female terminal 76 in order to properly orient the socket and the plug relative to one another. FIG. 12 further illustrates the insulation and protection provided the connections between the terminals and the wires provided by the present molded system.

Figure 13:
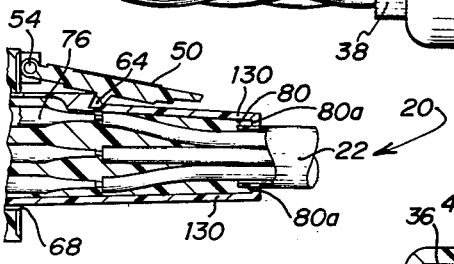
FIG. 13 is a partially sectioned view of a second embodiment of the plug of the present invention.

FIG. 13 illustrates a partially sectioned view of a second embodiment of the plug 20. The core 80 as shown in FIG. 7 is placed in an injection molding machine having suitable molds therein and a synthetic polymer is molded thereover to form a rigid outer plug housing 130. Housing 130 may be formed from any suitable rigid synthetic polymer such as high density nylon, polyethylene, polycarbonate or the like. The housing 130 includes a front face similar to that of housing 92 with apertures formed therein in order to expose the open ends of the female terminals 70. The rear portion of housing 130 is formed integrally and circumferentially about the entire length of plug core 80 and is molded to the plug core surface 80*a*. In this configuration, the portion of plug core 80 extending rearwardly of wings 98 (FIG. 11) is completely encapsulated by housing 130. Housing 130 further includes an aperture 132, whch is approximately equal to the diameter of the plug core rear face aperture and the diameter of cable 22. This configuration of housing 130 provides a strain relief to eliminate the stress placed upon cable 22 at the connection between the cable 22 and plug core 80. In addition, the molding of the housing 130 around the entire plug core 80 improves the seal between the cable 22 and plug 20 thereby improving the watertight and weathertight characteristics of the electrical connector system.

Figure 14:
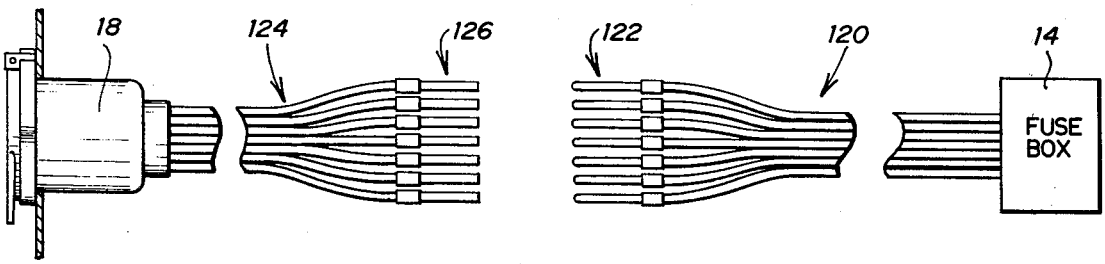
FIG. 14 is a somewhat diagrammatic illustration of the interconnection of the present socket with the fuse box of an over-the-road tractor.

FIG. 14 illustrates a somewhat diagrammatic view illustrating the interconnection of the socket 18 with the fuse box 14 of the tractor. Normally, the fuse box 14 will include a plurality of wires 120 extending therefrom. Male terminals 122 may be crimped to the ends of the wires 120. Socket 18 will be provided with a plurality of wires 124 extending therefrom. Female terminals 126 are crimped to the end of wires 124. Male terminals 122 are then inserted into female terminals 126 in order to provide interconnection between the fuse box 14 and the socket 18. Similar connections may be made between the trailer electrical terminal box 30 and the socket 26.

It will thus be seen that the present invention provides an electrical connector system particularly adapted for use to provide electrical power between a towing vehicle and a trailer. The present system is fully assembled at the factory and installed on existing tractor-trailers with the use of standard terminals or quick connect studs in the manner shown. The cable 22 may be provided with a plurality of standard sizes, such that a unitary cable and plug configuration may be sold and installed, thereby eliminating the requirement of attaching plugs during installation. The fully integrally formed system is thus watertight and weathertight, and is not subject to maintenance problems of socket-plug systems which utilize metal housings. The molded plastic plug and socket configurations provide excellent long-lasting protection and electrical characteristics to the connections between the terminals and the wires.

Whereas the present invention has been described with respect to specific embodiments thereof, it will be understood that various changes and modifications will be suggested to one skilled in the art, and it is intended to encompass such changes and modifications as fall within the scope of the appended claims.

What is claimed is:

1. An electrical connector system for supplying electrical power from electrical wires in a tractor cab vehicle to electrical wires in a trailer comprising:

a first socket for being mounted to the tractor cab and for being wired to the electrical wires of the tractor cab, a second socket for being mounted in the trailer and for being wired to the electrical wires of the trailer, each of said sockets including a plurality of male terminals each connected at the rear to one of the electrical wires in the tractor cab or trailer, means for supporting said male terminals such that said male terminals are maintained at a predetermined orientation within each of said sockets, means for insulating said male terminals from one another and for insulating said male terminals from an external environment, each of said sockets having a circular aperture encompassing the forward ends of said male terminals and terminating in a rear face portion within said socket, each of said sockets including flanges for attachment to a wall of the tractor cab or trailer, an insulated cable having a predetermined length with a plurality of electrical cable wires extending therethrough to extend between said first and second sockets when attached to the trailer and the tractor cab, first and second identical plugs integrally molded to opposite ends of said cable such that said plugs and insulated cable comprise an integral unitary member of a length to extend between said sockets mounted on the tractor cab or trailer, each of said plugs including a plurality of female terminals dimensioned and oriented for mating with said male terminals of either of said sockets and each female terminal connected at the rear of one of said plurality of cable wires within said cable, each of said plugs further having an elastomeric plug core surrounding the rear portion of said female terminals and portions of said plurality of cable wires, such that said female terminals are maintained at a predetermined orientation for mating with said male terminals and wherein the connections between said female terminals and said plurality of cable wires are covered and insulated, each of said plug cores having outwardly extending wings, each of said plug cores having a front face portion including a plurality of apertures for receiving the open ends of said female terminals, each of said plug cores further having a rear face portion including an aperture to permit said cable to extend from said plug cores, a pair of cylindrical shaped plug housings having first and second ends, fabricated from generally rigid synthetic polymer formed integrally and circumferentially about said plug cores and including outwardly extending wings formed integrally about said plug core outwardly extending wings for enabling removal of said plugs from said sprockets, said first end of each of said plug housing having a diameter approximately equal to the diameter of said plug core front face portion and including apertures mating with said apertures in said plug core, said first ends of said plug housings having diameters dimensioned to be closely received within said circular apertures within said sockets and to be disposed adjacent said rear face of said sockets, wherein a watertight electrical connection may be made between the tractor cab and the trailer, and said second ends of said plug housings having diameters approximately equal to the diameter of said plug core rear face aperture and formed integrally with said plug core rear face portions to thereby provide a strain relief for said insulated cable and a watertight seal between said insulated cable and said plug cores.

2. The electrical connector system of claim 1 wherein said second end of each said plug housing has a diameter approximately equal to the diameter of said plug core rear face portion.

3. The electrical connector system of claim 1 wherein the diameter of said plug core front face portions are less than the diameter of said plug core rear face portions.

* * * * *